US009082561B2

(12) United States Patent
Reuber et al.

(10) Patent No.: US 9,082,561 B2
(45) Date of Patent: Jul. 14, 2015

(54) MEDIUM VOLTAGE CIRCUIT BREAKER ARRANGEMENT OPERATED BY A TRANSMISSION MECHANISM

(71) Applicant: ABB Technology AG, Zürich (CH)

(72) Inventors: Christian Reuber, Willich (DE); Dietmar Gentsch, Ratingen (DE)

(73) Assignee: ABB TECHNOLOGY AG, Zurich (CH)

( * ) Notice: Subject to any disclaimer, the term of this patent is extended or adjusted under 35 U.S.C. 154(b) by 0 days.

(21) Appl. No.: 13/766,178

(22) Filed: Feb. 13, 2013

(65) Prior Publication Data

US 2013/0153377 A1 Jun. 20, 2013

Related U.S. Application Data

(63) Continuation of application No. PCT/EP2011/004060, filed on Aug. 12, 2011.

(30) Foreign Application Priority Data

Aug. 13, 2010 (EP) ..... 10008455

(51) Int. Cl.
*H01H 15/00* (2006.01)
*H01H 15/10* (2006.01)
(Continued)

(52) U.S. Cl.
CPC ..... *H01H 3/42* (2013.01); *H01H 15/00* (2013.01); *H01H 33/42* (2013.01); *H01H 9/563* (2013.01); *H01H 33/022* (2013.01); *H01H 33/666* (2013.01)

(58) Field of Classification Search
CPC ..... H01H 31/00; H01H 9/00; H01H 9/02; H01H 13/50; H01H 15/10; H01H 15/102; H01H 15/105; H01H 15/16; H01H 19/00; H01H 69/00; H01H 71/10; H01H 71/1009; H01H 71/52; H01H 71/56; H01H 73/00; H01H 73/28; H01H 75/00; H01H 2009/00; H01H 2009/0094; H01H 2019/00
USPC ..... 200/401, 400, 288, 50.19, 50.02, 410, 200/411, 430, 431, 428, 440–442, 318, 321, 200/324, 325, 327, 335, 6 R
See application file for complete search history.

(56) References Cited

U.S. PATENT DOCUMENTS 3,582,595 A * 6/1971 Stene ..... 200/400
3,689,721 A * 9/1972 McGuffie ..... 200/400
(Continued)

FOREIGN PATENT DOCUMENTS

DE 202006005092 U1 7/2006
DE 202008004868 U1 6/2008
EP 0817225 A1 1/1998

OTHER PUBLICATIONS

International Search Report (PCT/ISA/210) issued on Oct. 31, 2011, by the European Patent Office as the International Searching Authority for International Application No. PCT/EP2011/004060.
(Continued)

*Primary Examiner* — Edwin A. Leon
*Assistant Examiner* — Anthony R. Jimenez
(74) *Attorney, Agent, or Firm* — Buchanan Ingersoll & Rooney PC

(57) ABSTRACT

A circuit breaker arrangement includes at least one pole part for switching an electrical medium to high voltage circuit by a respective pair of fixed and movable electrical contacts. A pushrod of a respective movable electrical contact is operated by a common actuator unit, which is mechanically connected to each pushrod via a transmission mechanism for transferring a switching force from the actuator unit to each pushrod. The transmission mechanism includes a crankshaft having at least one crank which is pivotally attached to one end of a connection rod. An opposite end of the connection rod is pivotally attached to an end of the pushrod of a corresponding pole part.

16 Claims, 2 Drawing Sheets

(51) Int. Cl.

| | |
|---|---|
| ***H01H 19/635*** | (2006.01) |
| ***H01H 3/42*** | (2006.01) |
| ***H01H 33/42*** | (2006.01) |
| *H01H 9/56* | (2006.01) |
| *H01H 33/02* | (2006.01) |
| *H01H 33/666* | (2006.01) |

(56) References Cited

U.S. PATENT DOCUMENTS

| | | | | |
|---|---|---|---|---|
| 3,730,622 | A * | 5/1973 | Freeman et al. | 399/76 |
| 3,806,684 | A | 4/1974 | Hauser | |
| 4,563,554 | A | 1/1986 | Perrenoud | |
| 6,072,136 | A * | 6/2000 | Wehrli et al. | 200/401 |
| 6,313,424 | B1 | 11/2001 | Bachofen | |
| 6,466,117 | B2 * | 10/2002 | Castonguay et al. | 335/172 |

OTHER PUBLICATIONS

Written Opinion (PCT/ISA/237) issued on Oct. 31, 2011, by the European Patent Office as the International Searching Authority for International Application No. PCT/EP2011/004060.

European Search Report Issued Dec. 29, 2010 for European Application No. 10008455.7.

* cited by examiner

MEDIUM VOLTAGE CIRCUIT BREAKER ARRANGEMENT OPERATED BY A TRANSMISSION MECHANISM

RELATED APPLICATIONS

This application claims priority as a continuation application under 35 U.S.C. §120 to PCT/EP2011/004060, which was filed as an International Application on Aug. 12, 2011 designating the U.S., and which claims priority to European Application 10008455.7 filed in Europe on Aug. 13, 2010. The entire contents of these applications are hereby incorporated by reference in their entireties.

FIELD

The present disclosure relates to a circuit breaker arrangement including at least one pole part for switching an electrical medium voltage to high voltage circuit by a respective pair of a fixed electrical contact and a movable electrical contact, which is operated by a pushrod. A common actuator unit operates each pushrod and is driven by a transmission mechanism for transferring a switching force from the actuator unit to each pushrod.

BACKGROUND INFORMATION

Circuit breakers of this type interrupt the current by creating and extinguishing the arc in a vacuum container. Vacuum circuit breakers have been developed to have a longer live expectancy than air circuit breakers. A vacuum circuit breaker includes one electrical pole per phase, wherein each pole part includes an interrupter chamber, which can be a vacuum interrupter or a chamber filled with $SF_6$ or oil. Further, the poles include a drive rod for operating a movable electrical contact of the pair of electrical contacts, where the drive rod is accommodated inside the interrupter chamber. Circuit breakers of the present disclosure are used in the field of medium—voltage to high—voltage applications.

EP 0 817 225 A1 discloses a medium-voltage circuit breaker arrangement with three pole parts mounted on a common mounting surface of a housing for accommodating drive means for synchronously operating the moveable electrical contact of each pole part.

Each pole part contains a pair of electrical contacts which are a arranged inside of a switching chamber insulator, which is supported on a mechanism chasing attached to the box-type housing.

A pivot shaft running transverse to the switching direction is arranged in each mechanism chasing of each pole part, penetrating the mechanism chasing and the housing. A rocker arm is fixedly secured to that part of the shaft running inside of the mechanism chasing, and is connected to the moveable electrical contact by an insulating rod arranged as a pushrod. The pushrod is articulated to the rocker arm at one end and the moveable electrical contact on the other end. All shafts are on a common level and are parallel to each other. The pivot angle of the rocker arms is generally within an angular arrangement of 50° to 130°. Both end-point positions of the rocker arms correspond to the off position of the circuit breaker. The part of each shaft within the housing has a bifurcated rocker link, both arms of which are provided with a slot running radially relative to the shaft access. A respective lever, also arranged in the housing, is provided for other services of the arms. These auxiliary levers are parallel to each other and are connected to each other by a rod or a bolt, protruding through the slots of the bifurcated rocker link, thereby forming a crank-type structure.

The rod or bolt of the center pole part is linked by a respective coupler to the bolt of the other pole parts. A drive coupler is articulated to the bolt of the interrupter unit, and is linked to one end to the driver lever. The driver lever is situated on a drive shaft of a common actuator unit. The transmission means for transferring the switching force from the actuator unit to each pole part is based on a drawbar principle. The drawbar runs from the common drive unit along the housing and is connected to each pole part as described above. Many single parts are necessary on the transmission part.

U.S. Pat. No. 3,806,684 discloses a special transmission mechanism for converting a hand-operated circuit breaker to a motor-operated circuit breaker.

The circuit breaker including a metallic housing structure and a circuit breaker mechanism is supported on the housing structure. The housing structure includes a base plate and a pair of side plates connected to the base plate with a pair of spaced generally parallel center plates.

A crank shaft is supported on these center plates with a closing cam supported on the crank shaft between the center plates. A pair of springs is connected to the crank shaft, at the opposed sites of the center plates, to provide suitable energy means for closing the circuit breaker contacts.

A jack shaft that is common to all of the pole parts and pivotally moveable to operate the moveable contacts for all of the pole parts is supported at the opposite ends thereof in bearings mounted on the site plats. The bearings on the center plates are open at one site to permit movement of the jack shaft into the open center plate bearings to provide assembly of the circuit breaker. A link that is supported on the site of the center plates engages a trip bar to ledge the circuit breaker in the reset operating position. Ledgering forces act on the trip bar in proximity to center plate.

The closing cam includes twin cam members with a roller ledge supported between the twin cam members. A closing ledge engages the roller ledge to hold the closing cam in the charged position until it is desired to close the circuit breaker. Thereupon, the closing ledge is operated to release the roller and the start energy of the closing springs services to operate the crank to thereby operate the jack shaft to close the electrical contacts.

Due to the double-function of the disclosed technical solution, the transmission means for transferring the switching force to each pole part have a complex design. However, the transmission means are based on a rotation principal of a common jack shaft, on which lever arms are attached for operating the pushrods of each pole part.

SUMMARY

An exemplary embodiment of the present disclosure provides a circuit breaker arrangement which includes at least one pole part configured to switch an electrical medium to high voltage circuit by a respective pair of a fixed electrical contact and a movable electrical contact. The exemplary circuit breaker arrangement also includes at least one pushrod configured to move a corresponding movable electrical contact of the at least one of pole part, respectively. In addition, the exemplary circuit breaker arrangement includes a common actuator unit configured to operate each pushrod, and a transmission means for transferring a switching force from the actuator unit to each pushrod. The transmission means mechanically connects the actuator unit to each pushrod. The transmission means includes a crankshaft having at least one crank and at least one connection rod. The at least one crank is pivotally attached to a first end of a corresponding one of the at least one connection rod. A second end of the corresponding one of the at least one connection rod opposite to the first end is pivotally attached to an end of a corresponding one of the at least one pushrod of a corresponding one of the at least one pole part to move the corresponding pushrod.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
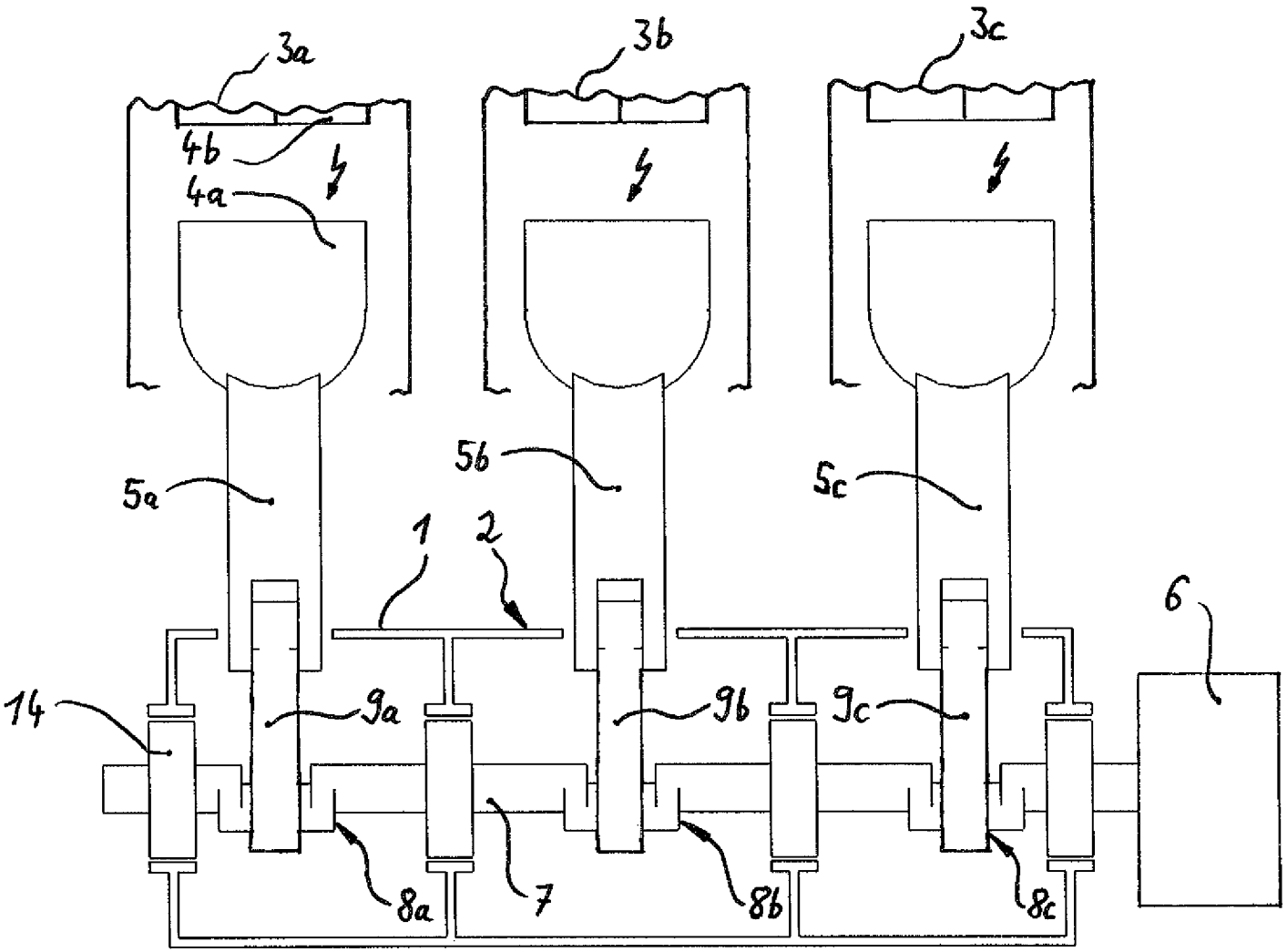
FIG. 1 is a schematic front view of a circuit breaker arrangement with transmission means including a unique crank shaft according to an exemplary embodiment of the present disclosure.

Exemplary embodiments of the present disclosure provide a circuit breaker arrangement which includes a rotation shaft for transferring a switching force to each pole part. The exemplary arrangement includes a reduced number of parts which are easy to manufacture and assemble into a small housing of the circuit breaker arrangement.

According to an exemplary embodiment of the present disclosure, a circuit breaker arrangement is provided with a unique crank shaft arrangement for transmission purpose. The transmission means includes a crank shaft having—according to the number of the pole parts—at least one crank which is pivotally attached to one end of a connection rod, wherein the opposite end of the connection rod is pivotally attached to an end of the pushrod of the corresponding pole part.

For operating the pushrod of each pole part, only a corresponding connection rod is connected to the common crank shaft. No further levers or other linkage means are necessary. Accordingly, only a few single parts have to be assembled inside the housing of the circuit breaker arrangement during the mounting process.

In accordance with an exemplary embodiment, all pole parts of the circuit breaker arrangement are arranged one to another in a line formation on a common surface of the housing in order to ensure an exact positioning of the pole parts relative to the crank shaft.

In accordance with an exemplary embodiment, to ensure a simultaneously closed electrical switching position of all pole parts, all cranks of the crank shaft have a common upward position in the direction of the neighbouring pole parts. The open electrical switching position of all pole parts can differ from the closed electrical switching position by a torsion angle of 180° of the crank shaft, for example.

In order to generate the closed switching position as well as the open switching position, the common actuator unit can generate a rotary motion for pivotally operating the crank shaft. Thus, the common actuator unit could be an electric motor, for example.

According to an exemplary embodiment of the present disclosure, the crank shaft can rotate in the same direction for changing the electrical switching position. Thus, a first rotation of about 180° brings the pole parts from the open switching position into the closed switching position, while a second rotation with the same direction brings the pole parts into the open switching position again. Alternatively, the drive unit can be chosen in a way that the rotation is forward and back. In this case, the first rotation of about 180° brings the pole parts from the open switching position into the closed switching position, while the second rotation in opposite direction brings the pole parts back into the open position.

According to an exemplary embodiment of the present disclosure, at least one rotating mass is arranged on the crank shaft in order to increase the rotary inertia. Thus, the rotating mass supports the dynamic of the actuator unit and optimizes the travel curve of the pole parts. In accordance with an exemplary embodiment, a single rotation mass is positioned at one end of the crank shaft, and the common actuator unit is positioned at the other end of the crank shaft. In accordance with an exemplary embodiment, several bearing discs can be inserted into the housing in order to pivot-mount the crank shaft inside the housing. Bearing discs support the crank shaft and minimize tolerances during operation.

In accordance with an exemplary embodiment, the open and closed positions of the pole parts can be chosen to be the top and bottom dead centers of the cranks, as a result of which, the force that the common actuator unit has to generate to maintain this position is quite low. For eventually latching the switching positions, the crank shaft can be rotated a little bit beyond the top dead center and then to block it from further rotation. In accordance with an exemplary embodiment, the close and open positions of the pole parts can be chosen to be the top. Then, the force from the contact springs of the moveable electrical contact between the pushrods and the pole parts will latch the circuit breaker arrangement in the closed switching position. For switching into the open switching position, one would let the drive rotate back, or release the blocking and rotate further in the same direction.

In accordance with an exemplary embodiment, the connection rods of the transmission means each include two symmetrically shaped parts, wherein each part has a first semicircle opening for pivotally attaching to the crank and a second semicircle opening for pivotally attaching to the pushrod. In other words, the connection rod is split into two halves and after insertion of the pushrods and the crank shaft to assemble these two halves as the last step to connect pole parts and common drive. The assembly of the halves can be made with one or more transverse running screw connections or with a tensible belt around the connection rod, for example.

The foregoing and other aspects of the present disclosure will become apparent from the following detailed description of exemplary embodiments of the present disclosure illustrated in the appended drawings.

The circuit breaker arrangement according to FIG. 1 includes a housing 1 with another mounting surface 2 on which three pole parts 3*a* to 3*c* are in line mounted.

Each pole part 3*a* to 3*c* contains a pair of corresponding inner electrical contacts 4*a* and 4*b* for switching a three-phase medium voltage circuit. The electrical contact 4*a* of each pole part 3*a* to 3*c* is arranged to be axially moveable by operation of a respective pushrod 5*a* to 5*c*, respectively. The opposite electrical contact 4*b* is fixed within the corresponding pole part 3*a* to 3*c*.

All pushrods 5*a* to 5*c* are synchronously operated by a common actuator unit 6, which is mechanically connected to each pushrod 5*a* to 5*c* via a unique transmission means of the present disclosure.

The transmission means for transferring the switching force generated by the actuator unit 6 to each pushrod 5*a* to 5*c* includes a crank shaft 7 having three cranks 8*a* to 8*c*. Each crank 8*a* to 8*c* is pivotally attached to one end of a connection rod 9*a* to 9*c*, respectively. The opposite end of the connection rod 9*a* to 9*c* is pivotally attached to the end of the pushrod 5*a* to 5*c* of the corresponding pole part 3*a* to 3*c*, respectively. Furthermore, the crank shaft 7 is pivot-mounted into the housing 1 by several bearing discs 14.

Figure 2:
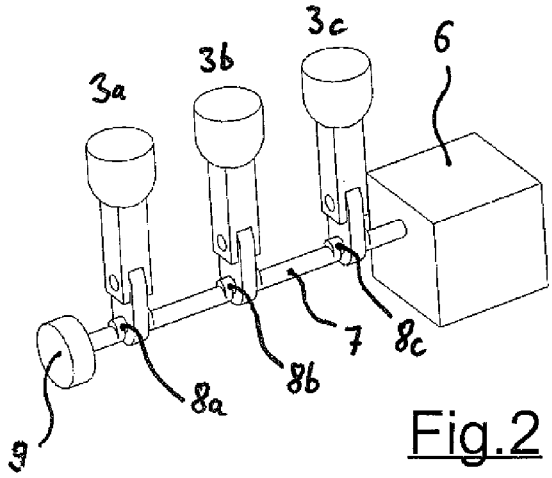
FIG. 2 is a schematic perspective view of a transmission means in the closed switching position according to an exemplary embodiment of the present disclosure.

According to the exemplary embodiment of FIG. 2, the common actuator unit 6 generates a rotary motion for pivotal operation of the crank shaft 7. A common upward position of all cranks in the direction of the neighbouring pole parts 3*a* to 3*c*—as shown in FIG. 2—causes a closed electrical switching position of all pole parts 3*a* to 3*c*. Furthermore, an additional rotating mass 9 is arranged at one end of the crank shaft 7. The common actuator unit 6 is positioned at the opposite end of the crank shaft 7. Due to the common actuator unit 6, the crank shaft 7 rotates in the same direction for changing the electrical switching position.

Figure 3:
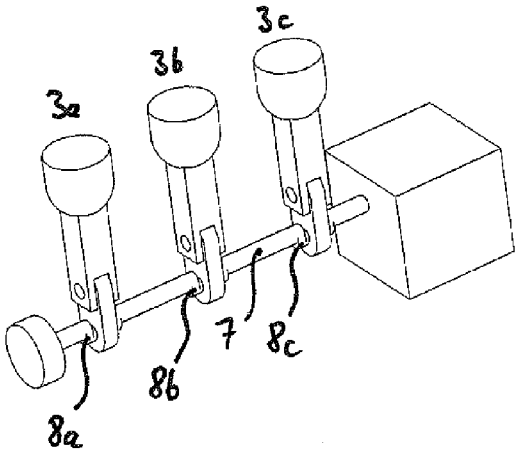
FIG. 3 is a schematic perspective view of a transmission means in the open switching position according to an exemplary embodiment of the present disclosure.

FIG. 3 shows the crank shaft 7 in a common downward position of all cranks 8*a* to 8*c* in which the pole parts 3*a* to 3*c* are in the open electrical switching position.

Figure 4:
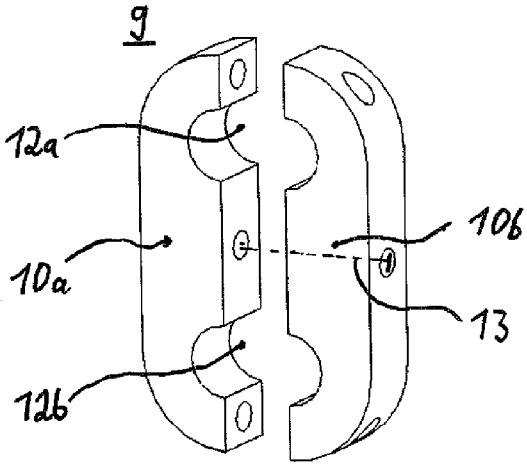
FIG. 4 is a perspective view of an exemplary embodiment of a connection rod.

According to the exemplary embodiment of FIG. 4, the connection rod 9 includes two symmetrically shaped parts 10*a* and 10*b*. Each part has a semicircle opening 12*a* for pivotally attaching to the crank and a second semicircle opening 12*b* for pivotally attaching to the pushrod. Both parts 10*a* und 10*b* of the connection rod 9 can be assembled by a schematically shown transverse screw connection 13, for example.

Figure 5:
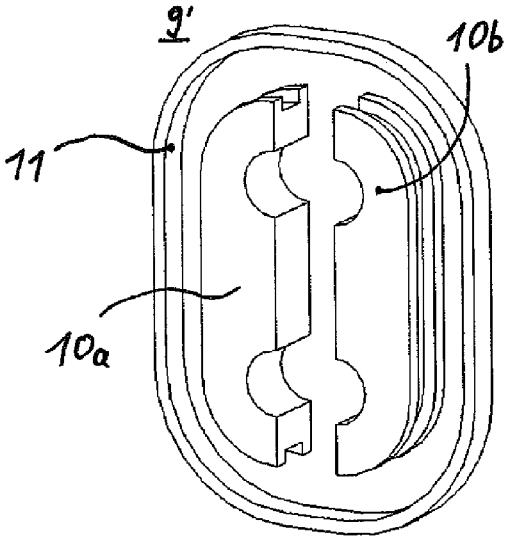
FIG. 5 is a perspective view of an exemplary embodiment of a connection rod.

In accordance with the exemplary embodiment of FIG. 5, the connection rod 9' includes two parts 10*a* und 10*b* which are shaped symmetrically. Both parts 10*a* und 10*b* can be assembled one to another by a surrounding tensible belt 11, for example.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 housing
2 mounting surface
3 pole part
4 electrical contact
5 pushrod
6 actuator unit
7 crank shaft
8 crank
9 connection rod
10 part of connection rod
11 tensible belt
12 semi circle opening
13 screw connection
14 bearing discs

What is claimed is:

1. A circuit breaker arrangement comprising:

at least one pole part configured to switch an electrical medium to high voltage circuit by a respective pair of a fixed electrical contact and a movable electrical contact;

at least one pushrod configured to move a corresponding movable electrical contact of the at least one of pole part, respectively;

a common actuator unit configured to operate each pushrod; and a transmission means for transferring a switching force from the actuator unit to each pushrod, the transmission means mechanically connecting the actuator unit to each pushrod, wherein the transmission means includes a crankshaft having at least one crank and at least one connection rod, the at least one crank being pivotally attached to a first end of a corresponding one of the at least one connection rod, wherein a second end of the corresponding one of the at least one connection rod opposite to the first end is pivotally attached to an end of a corresponding one of the at least one pushrod of a corresponding one of the at least one pole part to move the corresponding pushrod, wherein three pole parts are arranged in parallel one to another in a line formation corresponding with the crankshaft of the transmission means, and wherein the crankshaft is common to each pole part.

2. The circuit breaker arrangement according to claim 1, wherein all pole parts are arranged one to another in a line formation.

3. The circuit breaker arrangement according to claim 2, wherein a common upward position of all cranks of the crankshaft in the direction of neighbouring pole parts causes a closed electrical switching position of all pole parts.

4. The circuit breaker arrangement according to claim 2, wherein the closed electrical switching position is realized by a torsion angle of 180° of the crankshaft from the closed electrical switching position.

5. The circuit breaker arrangement according to claim 1, wherein the common actuator unit is configured to generate a rotary motion for pivotally operating the crankshaft.

6. The circuit breaker arrangement according to claim 1, wherein the crankshaft rotates in the same direction for changing an electrical switching position between an open position and a closed position.

7. Circuit breaker arrangement according to claim 1, comprising:

a rotating mass arranged on the crankshaft.

8. The circuit breaker arrangement according to claim 7, wherein the rotating mass is positioned at one of end of the crankshaft.

9. The circuit breaker arrangement according to claim 1, wherein the common actuator unit is positioned at one of end of the crankshaft.

10. The circuit breaker arrangement according to claim 1, wherein the connection rod includes two symmetrically shaped parts, wherein each part has a first semicircle opening for pivotally attaching to the crank and a second semicircle opening for pivotally attaching to the pushrod.

11. The circuit breaker arrangement according to claim 10, wherein both parts of the connection rod are assembled by at least one transverse screw connection.

12. The circuit breaker arrangement according to claim 10, wherein both parts of the connection rod are assembled by a surrounding tensible belt.

13. The circuit breaker arrangement according to claim 1, comprising:

a housing; and a plurality of bearing disks for pivot-mounting the crankshaft inside the housing.

14. The circuit breaker arrangement according to claim 13, wherein the housing supports the pole parts mounted in line on a common outer mounting surface.

15. The circuit breaker arrangement according to claim 7, comprising:

a plurality of pole parts, wherein the rotating mass is positioned between two of the pole parts.

16. The circuit breaker arrangement according to claim 1, comprising:

a plurality of pole parts, wherein the common actuator unit is arranged between two of the pole parts.

* * * * *